United States Patent [19]

Edwards

[11] 4,070,783

[45] Jan. 31, 1978

[54] THUMB TRIGGER AND AUTOMATIC SAFETY

[76] Inventor: Walter William Edwards, Rte. No. 1, Box No. 265, Bruno, Minn. 55712

[21] Appl. No.: 755,488

[22] Filed: Dec. 29, 1976

[51] Int. Cl.[2] ..... F41C 19/04; F41C 17/02

[52] U.S. Cl. ..... 42/69 R; 42/70 E

[58] Field of Search ..... 42/70 E, 70 R, 69 R, 42/69 A, 69 B, 41

[56] References Cited

U.S. PATENT DOCUMENTS

| | | | |
|---|---|---|---|
| 1,230,973 | 6/1917 | Yeaton | 42/69 R |
| 1,395,903 | 11/1921 | Buhl | 42/41 |
| 3,210,879 | 10/1965 | La Rue | 42/69 R |
| 4,010,566 | 3/1977 | Edwards | 42/69 R |

FOREIGN PATENT DOCUMENTS

| | | | |
|---|---|---|---|
| 434,675 | 12/1911 | France | 42/41 |

*Primary Examiner*—Charles T. Jordan

[57] ABSTRACT

A thumb trigger and automatic safety are provided for firearms. The automatic safety may be adapted to the gun or stock and is operable by spring loaded means provided on an upper portion of the firearm. Operation of the spring loaded safety and push button is by pressure from the thumb.

10 Claims, 1 Drawing Figure

THUMB TRIGGER AND AUTOMATIC SAFETY

BACKGROUND OF THE INVENTION

Since potential human error and other difficulties in manually precisely positioning the firearm sights when pulling the trigger during firing affects accuracy, a thumb trigger is proposed to insure uniform accuracy of position on the target.

The device is suitable for application to all firearms, and has an automatic safety that is released during the act of firing and which is returned to a locked position when the thumb trigger is released.

SUMMARY OF THE INVENTION

The primary object of the invention is to provide a thumb trigger which may be applied readily and inexpensively to all firearms. It will be more accurate than a finger trigger on firearms. It will be safer since a person can control his thumb better than his finger, and can see his thumb better on the thumb button than he can see his finger on a finger trigger.

Another object of the invention is to be able to line up the target faster, and more accurately, than with the old mechanism of a finger trigger.

Another object is to provide a push button mechanism having good construction, low cost, and being compact and light in weight.

Another object is that it is a great advantage for handicapped people, that have some fingers missing, if the person has only a thumb on one hand, the person can still use the thumb trigger and automatic safety.

Another object is that it will be less tiresome to push on a button with the thumb than to manually tug on a finger trigger.

Another object is that a person won't have an intermittent jiggling motion associated with the finger trying to find the trigger.

Another object of the invention is the spring loaded safety, the safety automatically goes on when a person moves his thumb off the thumb trigger, so there is no danger of the cartridge being struck by the firing pin and a person doesn't have to remember to put the safety on, since as the push button returns to its normal position the spring loaded safety returns back to its normal position.

BRIEF DESCRIPTION OF THE DRAWING

The invention will further be described with reference to the accompanying drawing wherein like numbers refer to like parts in the view and wherein:

The FIGURE is a horizontal plan view of a gun according to the invention with parts broken away to show details of the thumb trigger and automatic safety.

Figure 1:
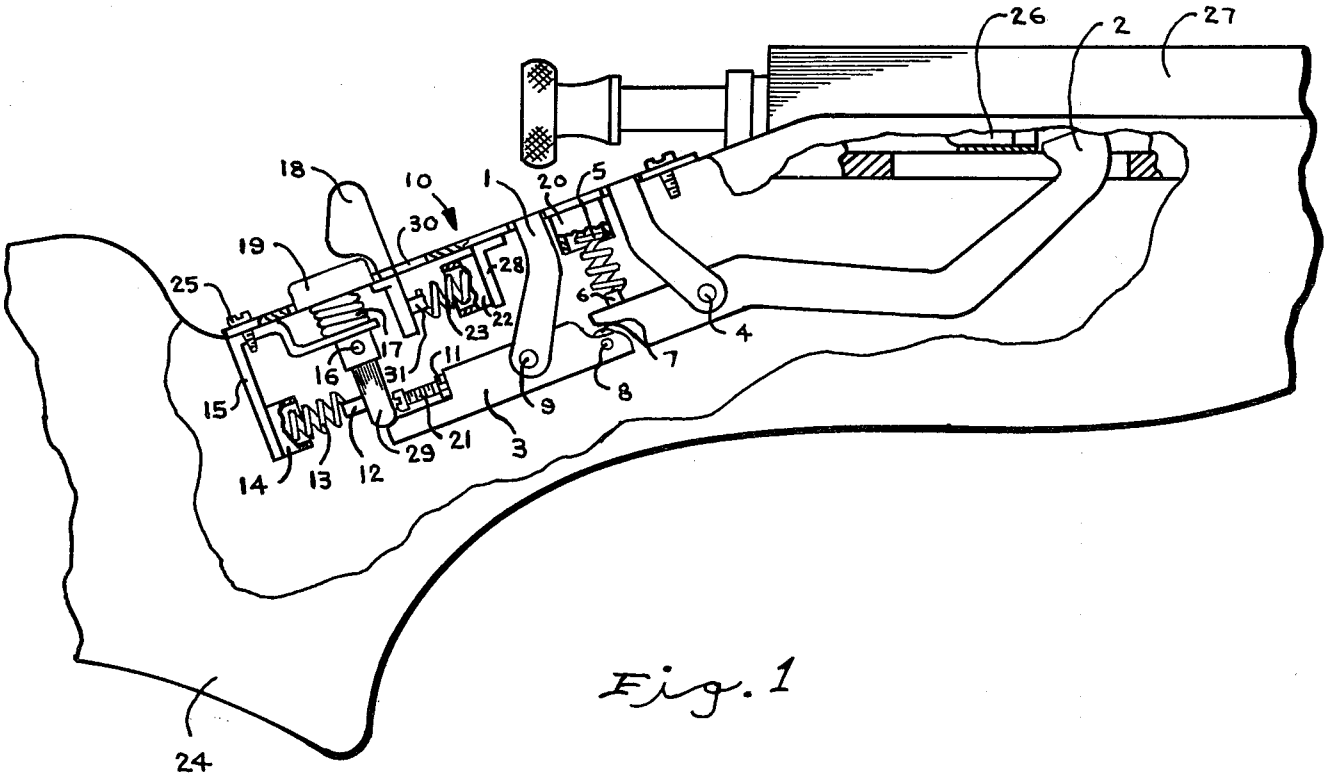

Before explaining the present invention in detail, it is to be understood that the invention is not limited in its application to the details of construction and arrangement of parts illustrated in the accompanying drawing, since the invention is capable of being installed in all new firearms and older models with a little modification, and other embodiments practiced or carried out in various ways. Also, it is to be understood that the phraseology or terminology employed herein is for the purpose of description and not of limitation. The scope of the invention being defined in the claims.

DESCRIPTION OF THE PREFERRED EMBODIMENTS

Referring now to the FIGURE, there is shown a device according to the present invention and generally designated by the numeral 10. The device 10 is useful on all firearms to increase the accuracy thereof in hitting a target. The device 10 includes a partially enclosed casing 1, and a bracket 15, welded to casing 1, to provide a holder for push button 19. Shaft 29 is inserted in a through hole in casing 1 and pin 16 keeps shaft 29 from falling out of bracket 15. Push button 19 is welded onto shaft 29 to provide a holder for trigger spring 17. An angle 28 is welded to casing 1 and tube 22 is welded to angle 28 to provide a holder for safety spring 23. Tube 20 is welded to casing 1 to provide a holder for spring 5 which returns large arm 2 back to its normal position after firing striker 26 has struck a cartridge. Large arm 2 has a pin 6 for mounting compression spring 5. Large arm 2 is mounted in two front tabs on casing 1, is pivotably attached via a pivot pin 4, press fitted into the two tabs nearest the barrel 27. Large arm 2 has a clearance hole therein for pivot pin 4 and the pivot point is located near the front end of the device 10. Small arm 3 is mounted for relative movement between two tabs near the center portion of casing 1, is pivotably attached via a pivot pin 9, press fitted into the tabs on casing 1, small arm 3 has a clearance hole therein for pivot pin 9 and the pivot point is located near the center if the device 10.

At the front end of small arm 3 is a roller bearing 7 mounted in place with pin 8 to be press fitted into small arm 3.

The shaft 29 rests on the rear end of small arm 3 within a little groove in small arm 3. A screw 21 and nut 11 are included so as to provide a little adjustment for shaft 29. Shaft 29 also has a pin 12 such that spring 13 can fit around pin 12 when spring 13 is inserted into tube 14 to secure shaft 29 onto small arm 3, when push button 19 is pressed.

At the upper portion of shaft 29 there is a compression spring 17 to make push button 19 return to normal position, after push button 19 has been engaged. Pin 16 is to hold shaft 29 in its normal place, so as not to fall out of bracket 15.

Bracket 15 has a hole therein for shaft 29 to be inserted therethrough, push button 19 can be welded to the end of shaft 29.

The safety 18 is mounted for movement in a horizontal slot 30 in casing 1, and has a lip engaging the underside of push button 19. The safety 18 is assembled by sliding the safety up through the hole for the push button 19, safety spring 23 is inserted into tube 22 and is secured by pin 31 on safety 18.

My thumb trigger and automatic safety has a very neat appearance, all the moving parts are contained in one casing 1, and may be pre-assembled and easily installed in all firearms with only three screws 25, mounting it into stock 24, or it could be welded to barrel 27. The thumb trigger and automatic safety may be used in any position and in any kind of weather, since a person can even push the thumb trigger and automatic safety with mittens on to protect his hands from freezing.

I claim:

1. A thumb trigger and automatic safety comprising: a partially enclosed casing having four tabs for locating two pivot points thereon, a swinging large arm pivoted about a pivot pin and secured thereby between two of said tabs near the front of said casing, said large arm having a clearance hole at said pivot point for receiving said pivot pin therein, said large arm having a radius slot therein for receiving a strike from a roller bearing, said large arm having a pin extending upwardly therefrom into a vertically oriented cylindrical tube containing a compression spring, said large arm extending toward the front end of the partially enclosed casing, said large arm having an angled bend at one end thereof for engaging a firing striker, and means for mounting said casing in a firearm for actuation by a thumb trigger.

2. A thumb trigger and safety according to claim 1, wherein a swinging small arm is pivoted about a pivot pin and secured thereby between two of said tabs near the center portion of said casing, said small arm having a clearance hole at said pivot point for receiving said pivot pin therein.

3. A thumb trigger and safety according to claim 1, wherein two of said tabs are located near the front end of said casing, said two tabs having aligned holes therein for alignment with said clearance hole in said large arm, said pivot pin being press fitted into said holes in said two tabs, and said large arm being movable from its normal position when said thumb trigger is actuated.

4. A thumb trigger and safety according to claim 2, wherein said two tabs located near the center portion of said casing have aligned holes therein for alignment with said clearance hole in said small arm, said small arm pivot pin being press fitted into said holes in said two tabs and said small arm being movable from its normal position when said thumb trigger is actuated, said small arm having a groove at its rear end for receiving one end of a shaft, a push button secured to said shaft by welding, and said shaft being actuated by a thumb trigger button.

5. A thumb trigger and safety according to claim 2, wherein said small arm has a roller bearing at one end mounted by a pin, said roller bearing moving freely, and means making both said small and large arms pivot more freely when said roller bearing on said small arm comes in contact with said large arm when said thumb trigger is actuated.

6. A thumb trigger and safety according to claim 2, wherein said small arm has a screw and nut for adjusting the thumb trigger, means mounting said screw and nut on said small arm, means helping to keep said thumb trigger in a groove on said small arm, and a shaft being actuated by a thumb trigger button.

7. A thumb trigger and safety according to claim 4, wherein said shaft stays in said groove on said small arm, said shaft having a pin extending from its rear end into a horizontally oriented cylindrical tube containing a compression spring, and means keeping said thumb trigger from slipping off said small arm.

8. A thumb trigger and safety according to claim 1, wherein said pin on said large arm engages said compression spring, and said spring biases said large arm to its normal position, after engaging a firing striker.

9. A thumb trigger and safety according to claim 1, wherein said automatic safety comprises: a safety mounted on an upper portion of said casing, said safety having a pin extending therefrom into a horizontally oriented cylindrical tube containing a compression spring for engaging said safety pin and biasing said safety to a safe position, means mounting said safety on said casing for actuation by the thumb, and a lip on said safety fitting around under a push button to hold said thumb trigger in a locked position when not being actuated.

10. A thumb trigger and safety according to claim 1, wherein said thumb trigger is mounted in a bracket welded to said casing, said bracket having a hole therein for receiving a shaft inserted therethrough, a compression spring mounted under a push button for returning the thumb trigger to its normal position, and a pin near the center portion of said shaft for keeping said thumb trigger from falling out of said bracket after said thumb trigger has been actuated by a part of the user's body.

* * * * *